US010570646B2

(12) United States Patent
Marsden

(10) Patent No.: US 10,570,646 B2
(45) Date of Patent: Feb. 25, 2020

(54) WINDOW LOCK ASSEMBLY

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 409 days.

(21) Appl. No.: 15/255,041

(22) Filed: Sep. 1, 2016

(65) Prior Publication Data

US 2017/0058580 A1 Mar. 2, 2017

Related U.S. Application Data

(63) Continuation of application No. 62/213,318, filed on Sep. 2, 2015.

(51) Int. Cl.
*E05B 65/00* (2006.01)
*E05C 17/36* (2006.01)

(52) U.S. Cl.
CPC ..... *E05B 65/0014* (2013.01); *E05C 17/36* (2013.01)

(58) Field of Classification Search
CPC ..... Y10T 292/283; Y10T 70/5164; Y10T 292/0992; Y10T 70/7915; Y10T 292/1057; E05C 17/365; E05C 17/36; E05C 19/184; Y10S 411/91; Y10S 292/53; E05B 73/0005; E05B 79/20
See application file for complete search history.

(56) References Cited

U.S. PATENT DOCUMENTS 795,882 A * 8/1905 Atkin ..... E05C 17/365 292/264
1,492,180 A * 4/1924 Pitrone ..... E05B 65/0864 244/129.3
2,867,468 A 1/1959 Bugge
2,981,090 A * 4/1961 Patriquin ..... E05C 17/365 292/264
3,101,603 A * 8/1963 North ..... E05C 17/365 292/264
3,125,875 A * 3/1964 Friedman ..... E05C 17/365 292/264
3,640,106 A 2/1972 Lorincz
4,105,231 A 8/1978 Huyssen
4,405,166 A * 9/1983 Lovis ..... E05B 65/0888 292/305
4,472,143 A 9/1984 Bennett et al.
5,285,666 A * 2/1994 Bartnicki ..... E05C 17/365 292/264
9,890,571 B1 * 2/2018 Marsden ..... E05C 17/36
2011/0173895 A1 7/2011 Lund et al.

FOREIGN PATENT DOCUMENTS

EP 3228789 A1 * 10/2017
WO WO 2014/108680 A1 7/2014

OTHER PUBLICATIONS

PCT/AU2016/000309, dated Nov. 4, 2016, International Search Report and Written Opinion.
International Search Report and Written Opinion for Application No. PCT/AU2016/000309, dated Nov. 4, 2016.

* cited by examiner

*Primary Examiner* — Mark A Williams
(74) *Attorney, Agent, or Firm* — Wolf, Greenfield & Sacks, P.C.

(57) ABSTRACT

A window lock assembly is provided for locking a window with a cord. The cord allows a window to be opened a small amount. The lock can be locked and unlocked without a key, and in some embodiments, can be operated with one hand.

16 Claims, 17 Drawing Sheets

WINDOW LOCK ASSEMBLY

RELATED APPLICATIONS

This application claims priority under 35 U.S.C. § 119(e) to U.S. Provisional Application Ser. No. 62/213,318, entitled "WINDOW LOCK ASSEMBLY" filed on Sep. 2, 2015, which is herein incorporated by reference in its entirety.

FIELD

This disclosure relates a window lock assembly for helping prevent children from opening a window, while still allowing an adult to disengage the lock assembly.

DISCUSSION OF THE RELATED ART

Household windows can be dangerous trap for toddlers and young children. Many older windows may contain faulty locking devices that present a safety hazard. Some window locks require a key, which requires an adult to retrieve the key prior to unlocking the window.

SUMMARY

Aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

According to one embodiment, a window lock includes a first mount configured to be attached to a first window component, a flexible cord attached to the first mount, and a cord lock attached to the flexible cord at a distance from the first mount. The window lock further includes a second mount including a lock receptor configured to removably receive the cord lock, the second mount being configured to be attached to a second window component. The second mount includes a cord lock blocker which is movable between a first position and a second position, wherein in the first position, the cord lock blocker blocks removal of the cord lock from the lock receptor, and in the second position, the cord lock blocker does not block removal of the cord lock. The cord lock blocker may be biased toward the first position and is movable to the second position by applying a force to a finger-graspable portion.

According to some embodiments disclosed herein, a window lock assembly is provided including a latch mounting base attached proximate to a window, a flexible latch cable extending from the latch mounting base, with the latch cable being attached to a latch. The latch may include at least one graspable surface that may permit operation with one hand, and a slot engagement member. A latch reception base may be attached to a window, with the latch reception base comprising a slot with a larger opening for receiving and removably holding the slot engagement member. The latch reception base may include a slider that extends outwardly from the latch reception base to move within the slot, wherein the slider comprises at least one graspable surface, a locking tab that holds the slider within the latch reception base, wherein the slider holds the slot engagement member within the latch reception base.

In some embodiments, the window lock assembly comprises rounded edges. In some embodiments, the latch mounting base comprises adhesive on a rear surface for attachment to a window frame. In some embodiments, the latch mounting base comprises adhesive on a rear surface for attachment to a window glass. In some embodiments, the latch mounting base comprises at least one threaded hole for receiving screws for attachment to the window frame. In some embodiments, the latch reception base comprises adhesive on a rear surface for attachment to a window frame. In some embodiments, the latch reception base comprises adhesive on a rear surface for attachment to a window glass. In some embodiments, the latch reception base comprises at least one threaded hole for receiving screws for attachment to the window frame. In some embodiments, the slider extends outwardly from the latch reception base in a substantially perpendicular direction.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
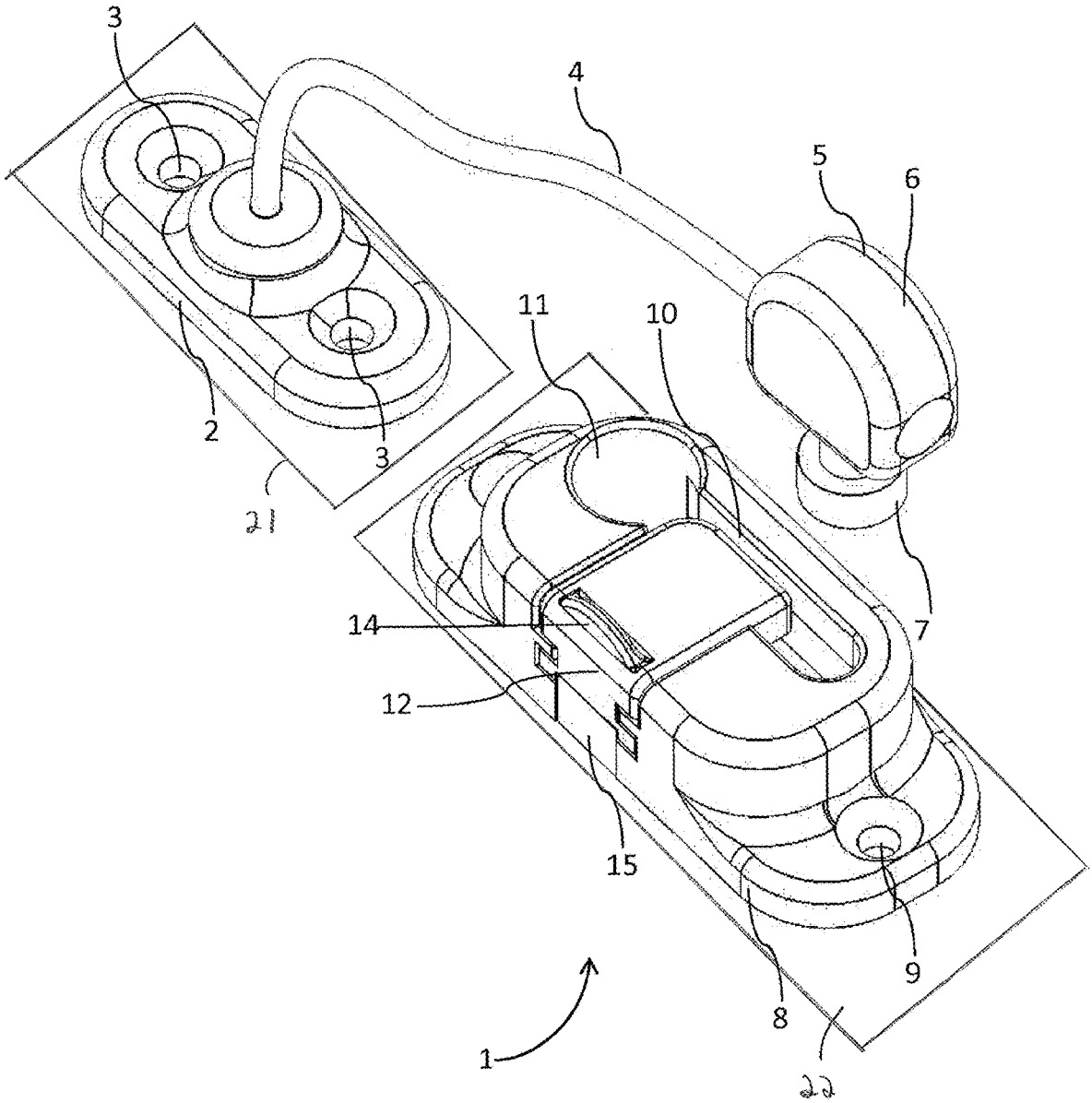
FIG. 1 is an isometric view of a window lock assembly in the unlatched configuration according to one embodiment.

While several variations of the present invention have been illustrated by way of example in particular embodiments, it is apparent that further embodiments could be developed within the spirit and scope of the present invention, or the inventive concept of an window lock assembly. However, it is to be expressly understood that such modifications and adaptations are within the spirit and scope of the present invention, and are inclusive, but not limited to the following appended claims as set forth.

In some embodiments, a cord-based window lock permits a window to be opened by a small amount. By using an arrangement that does not require a key, the lock can be unlocked quickly and easily by an adult without having to go to a separate location to retrieve a key.

According to one embodiment, a window lock assembly 1 includes a first mount which is shown in this embodiment as a substantially flat latch mounting base 2 with two threaded screw holes 3 for attaching the latch mounting base 2 to a first window component, such as a window frame 21. In other embodiments, the latch mounting base 2 may be adhered to a window frame or to the glass of a window. Other suitable attachment methods also may be used.

Attached to the latch mounting base 2 is a flexible cord, which is shown as a flexible latch cable 4. A cord lock is attached to the flexible cord at a distance from the latch mounting base 2. The cord lock is shown as a latch 5 in this embodiment, and includes a top extended portion 6 that can be easily grasped by an adult, and also includes an insertion member such as a bottom latch engagement member 7.

A second mount, such as latch reception base 8, is configured to be attached to a second window component, such as a window jamb or a frame 22 of a different sash, as just two examples.

The second mount may include two threaded screw holes 9 for attaching the latch reception base 8 to the second window component. In some embodiments, the latch reception base 8 may be adhered to a window frame or to the window glass. Other suitable attachment methods also may be used.

The latch reception base 8 includes a lock receptor, which in some embodiments includes an opening 11 that is configured to receive the bottom latch engagement member 7. In some embodiments, the latch engagement member 7 (or other cord lock) is slideable within a channel 10. Other suitable lock receptors may be used in various embodiments.

Figure 2:
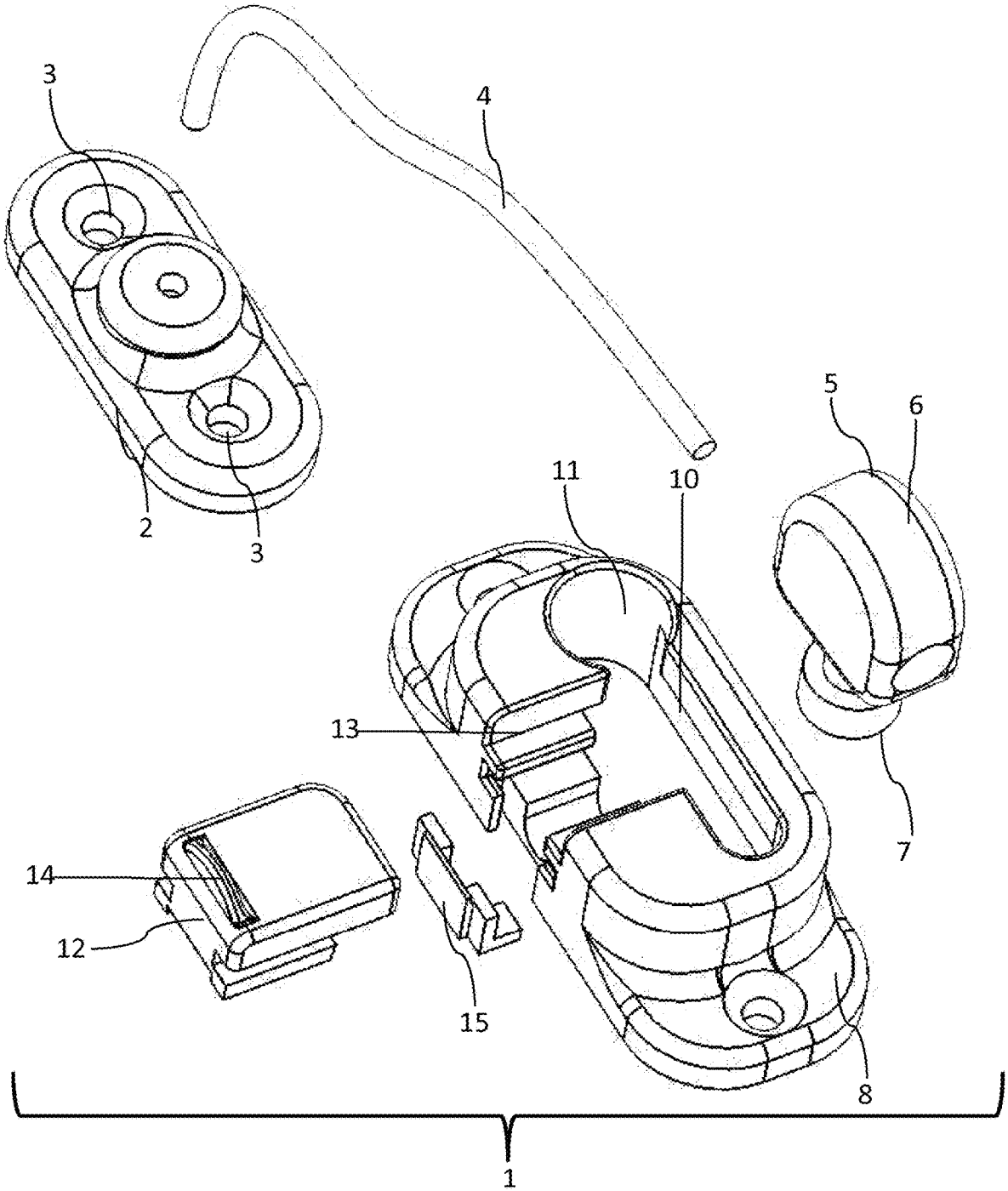
FIG. 2 is an exploded isometric view of the window lock assembly.
Figure 3:
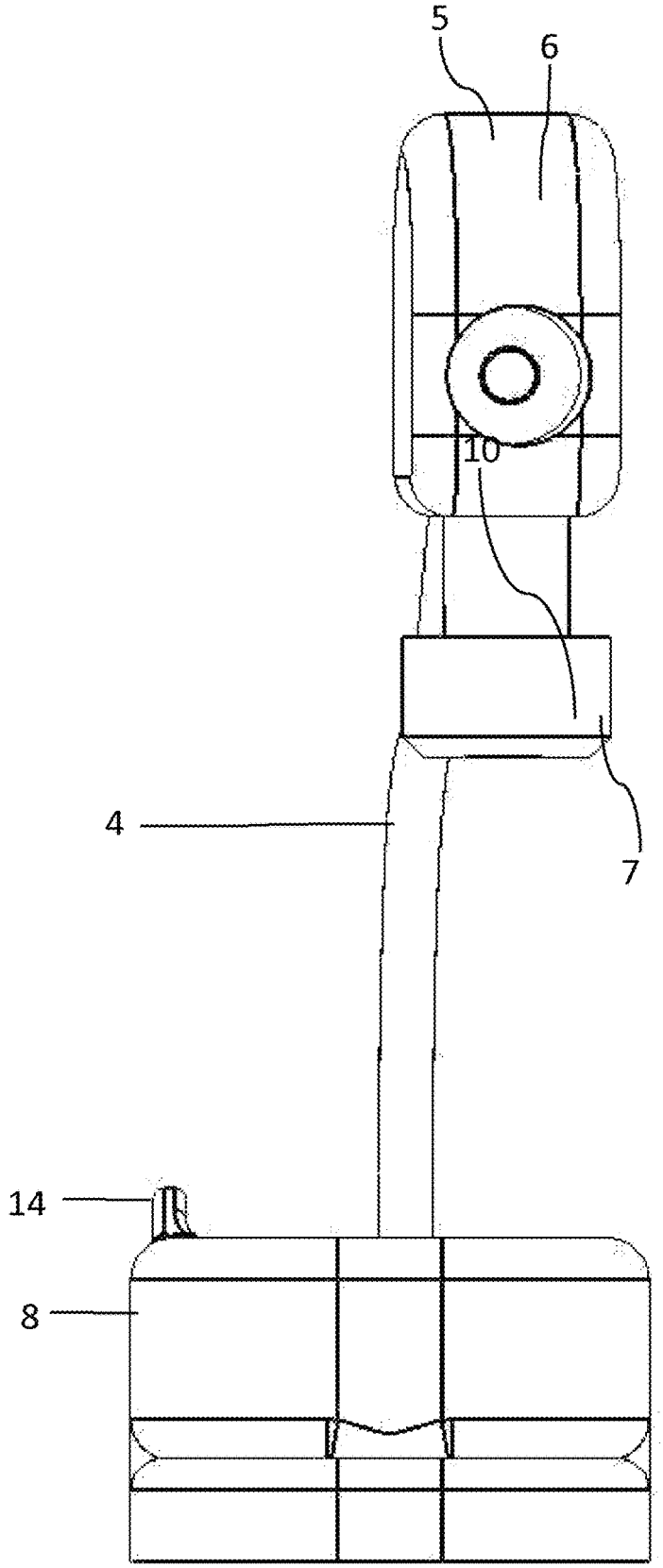
FIG. 3 is a front view of the window lock assembly in the unlatched position.
Figure 4:
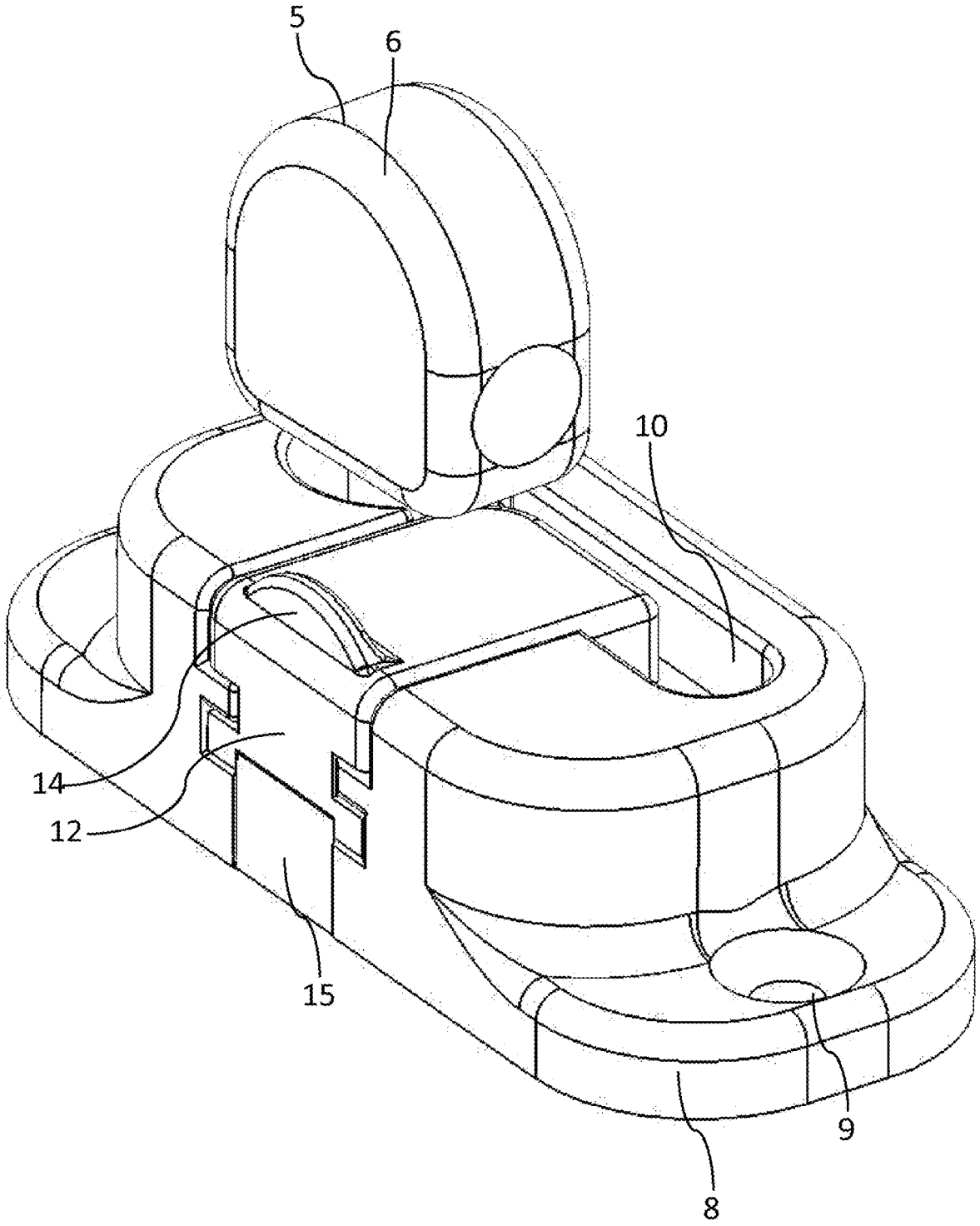
FIG. 4 is an isometric view of the window lock assembly in the latched position.
Figure 5:
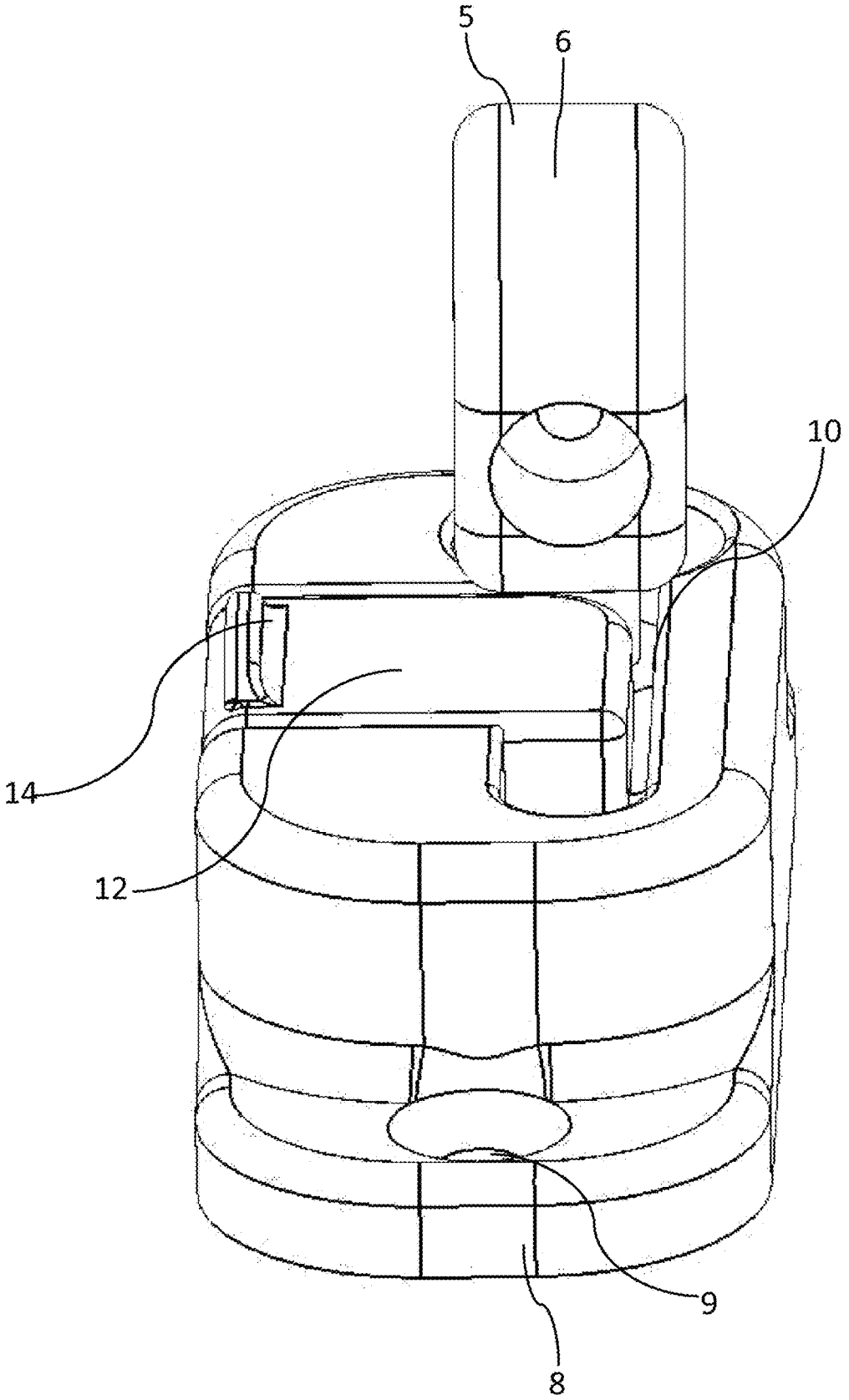
FIG. 5 is a front view of the window lock assembly in the latched position.
Figure 6:
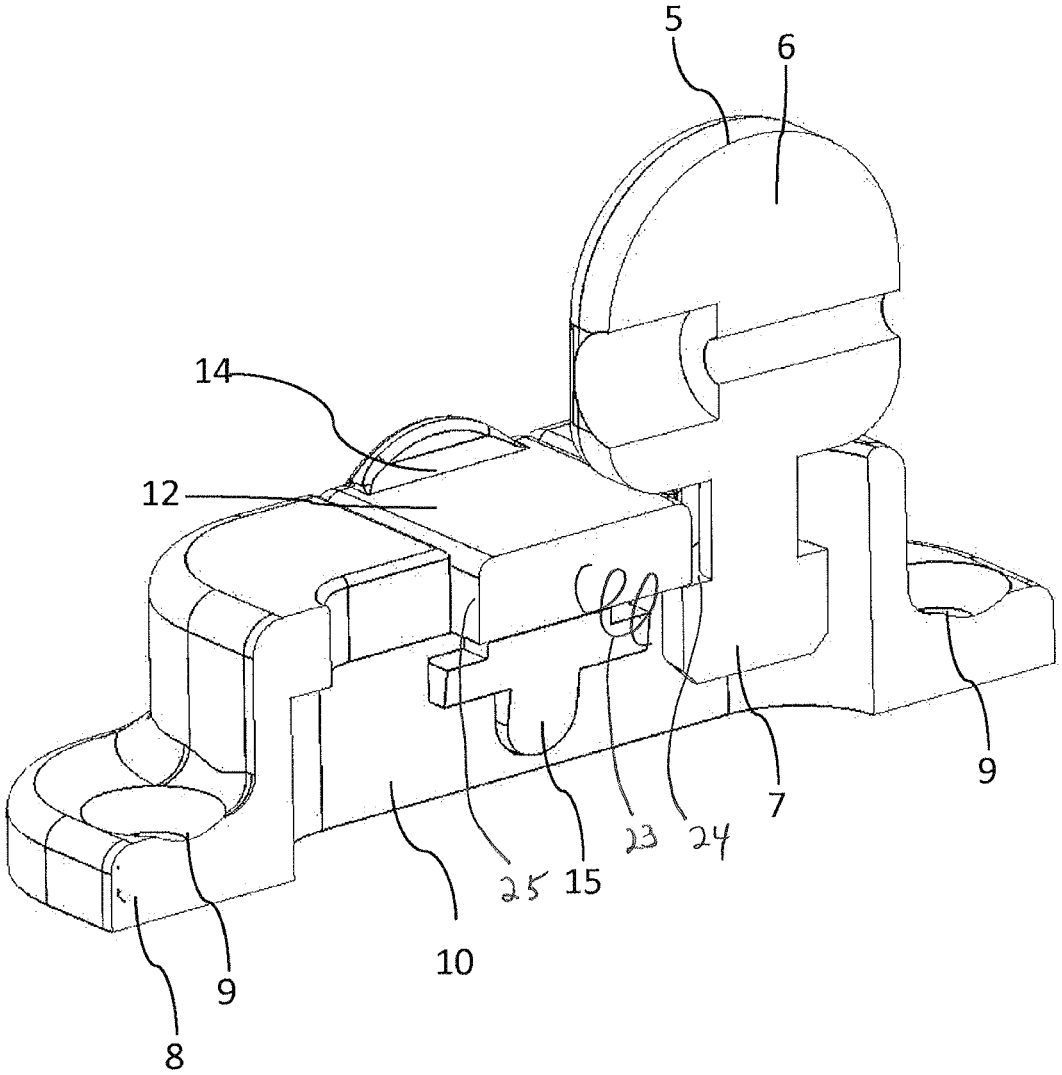
FIG. 6 is an isometric cross-sectional view of the window lock assembly in the latched position.
Figure 7:
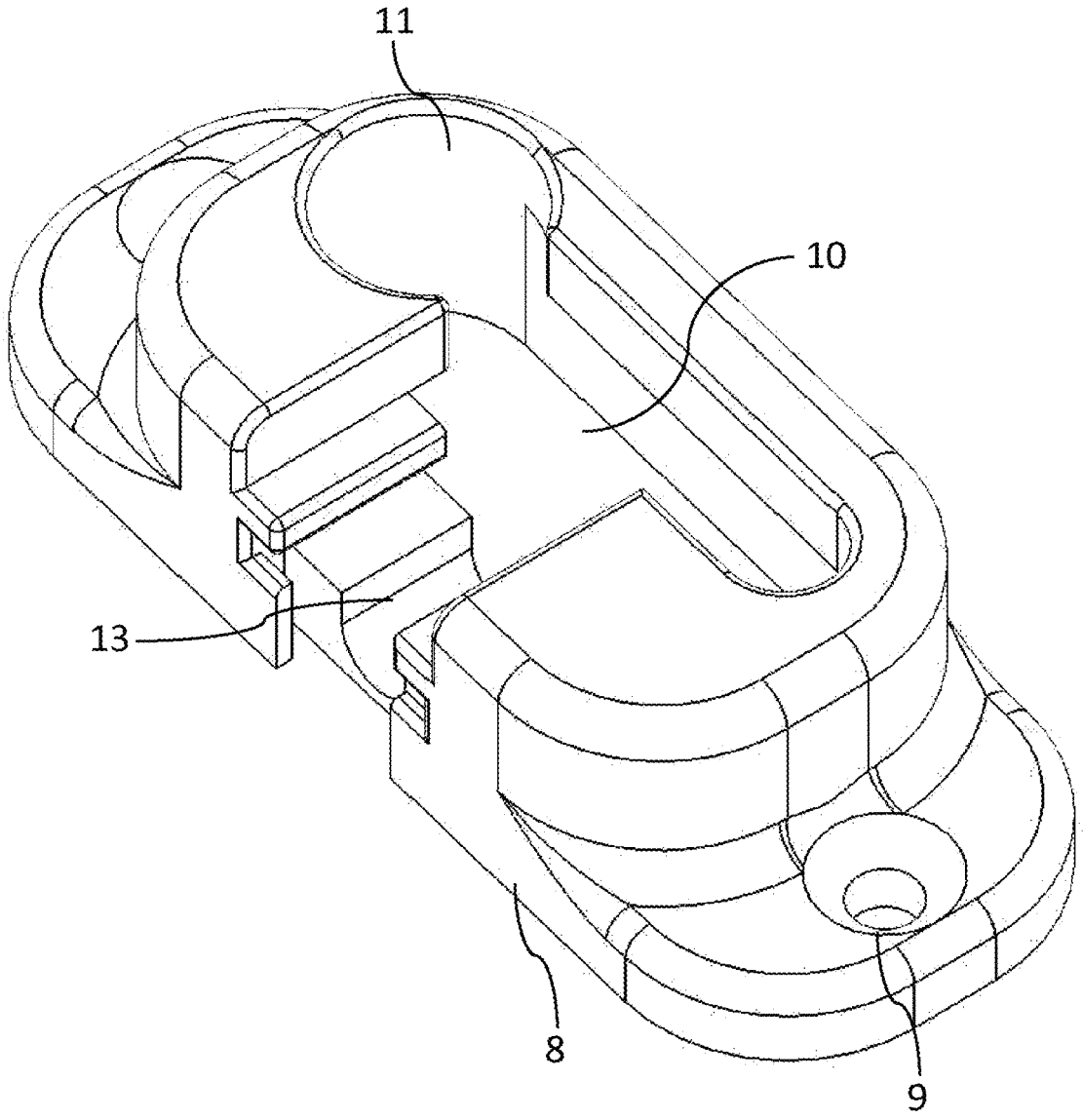
FIG. 7 is an isometric view of the latch receiving base.
Figure 8:
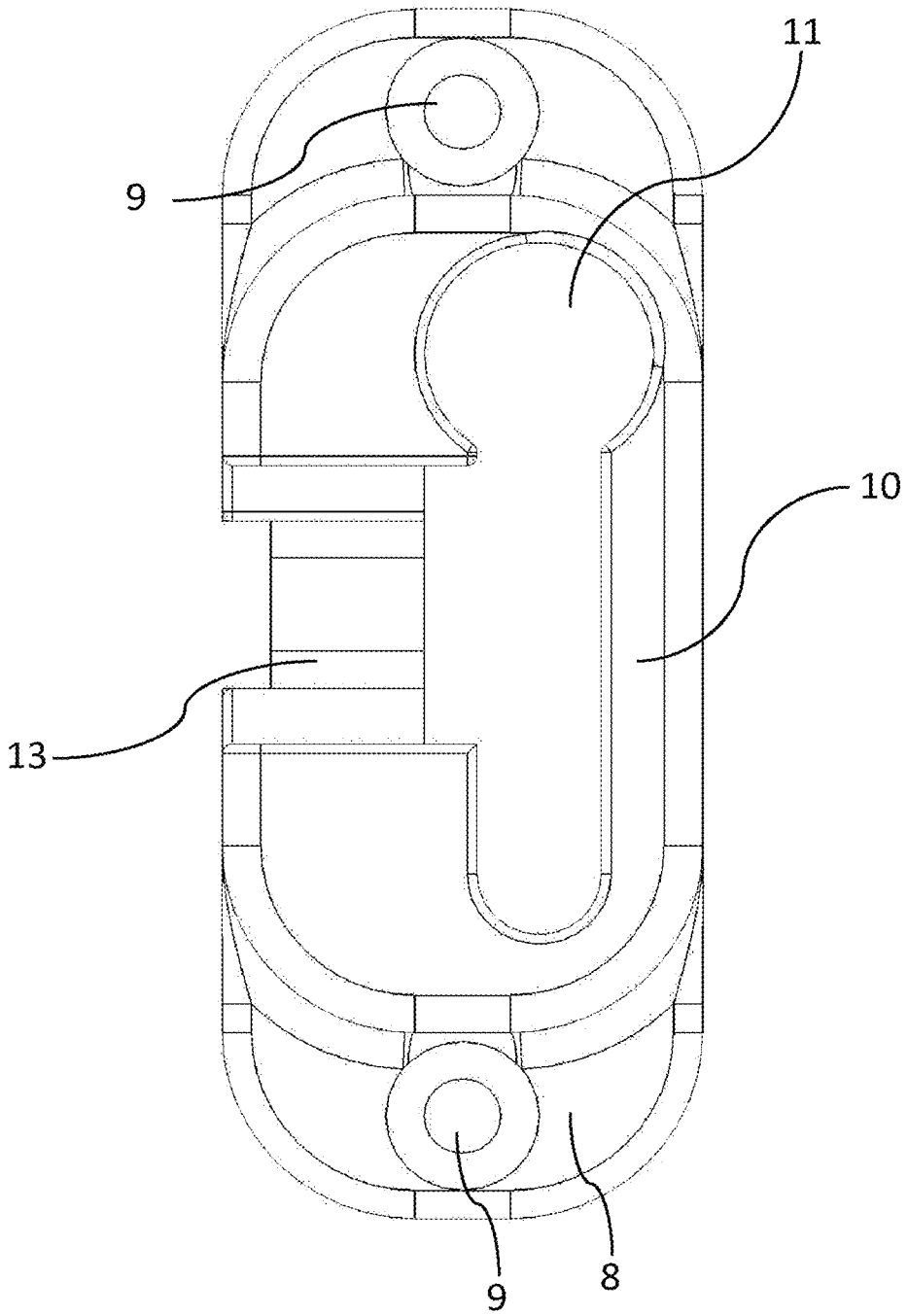
FIG. 8 is a top view of the latch receiving base.
Figure 9:
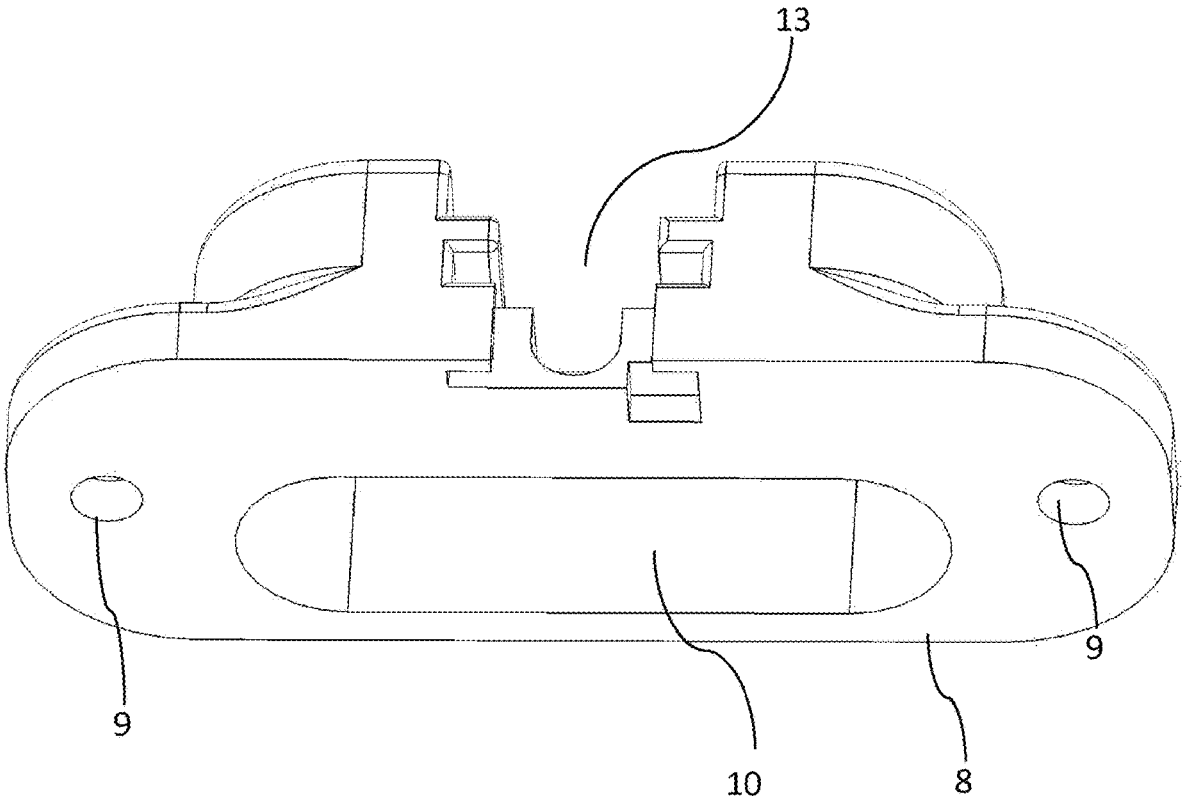
FIG. 9 is a bottom isometric view of the latch receiving base.
Figure 10:
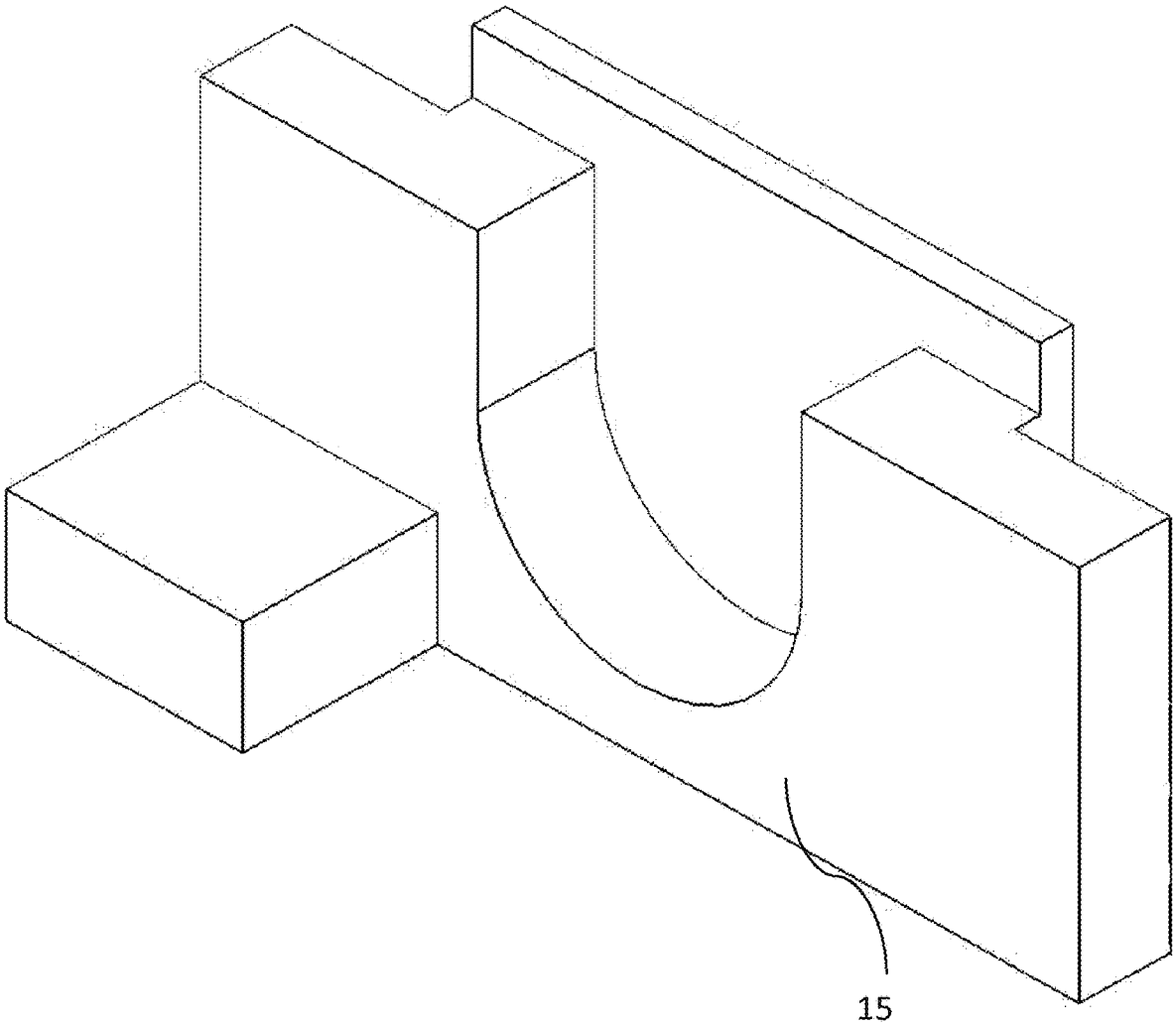
FIG. 10 is an isometric view of the locking tab.
Figure 11:
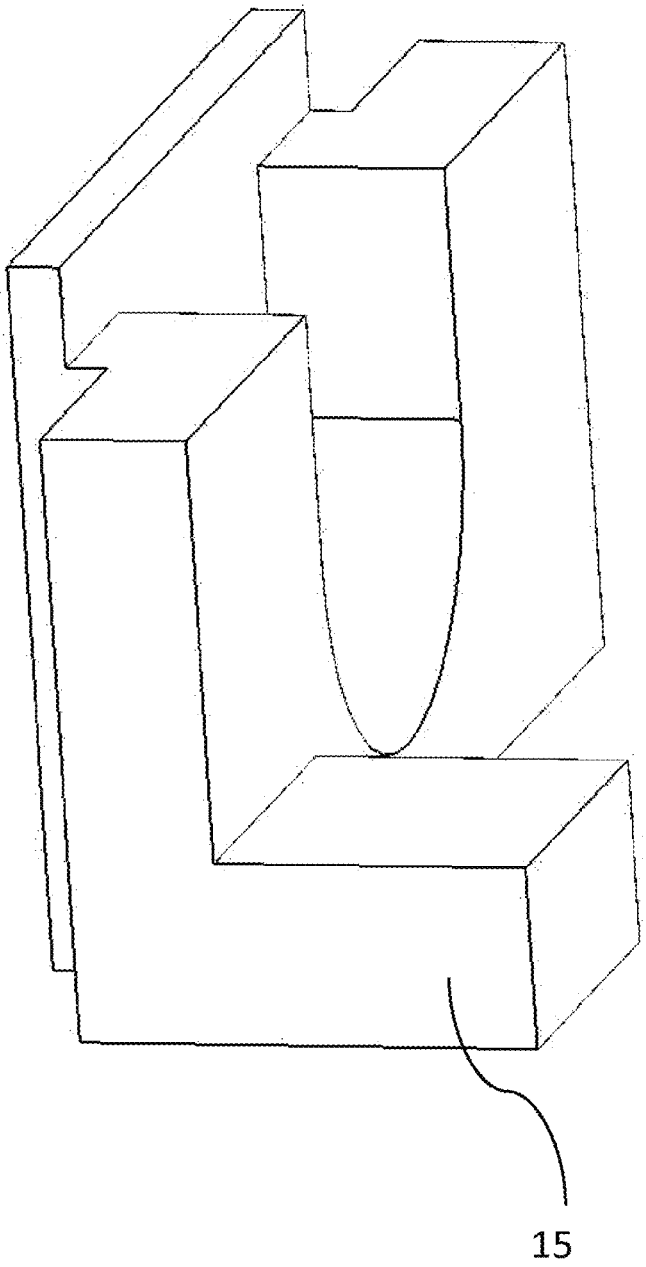
FIG. 11 is a side view of the locking tab.
Figure 12:
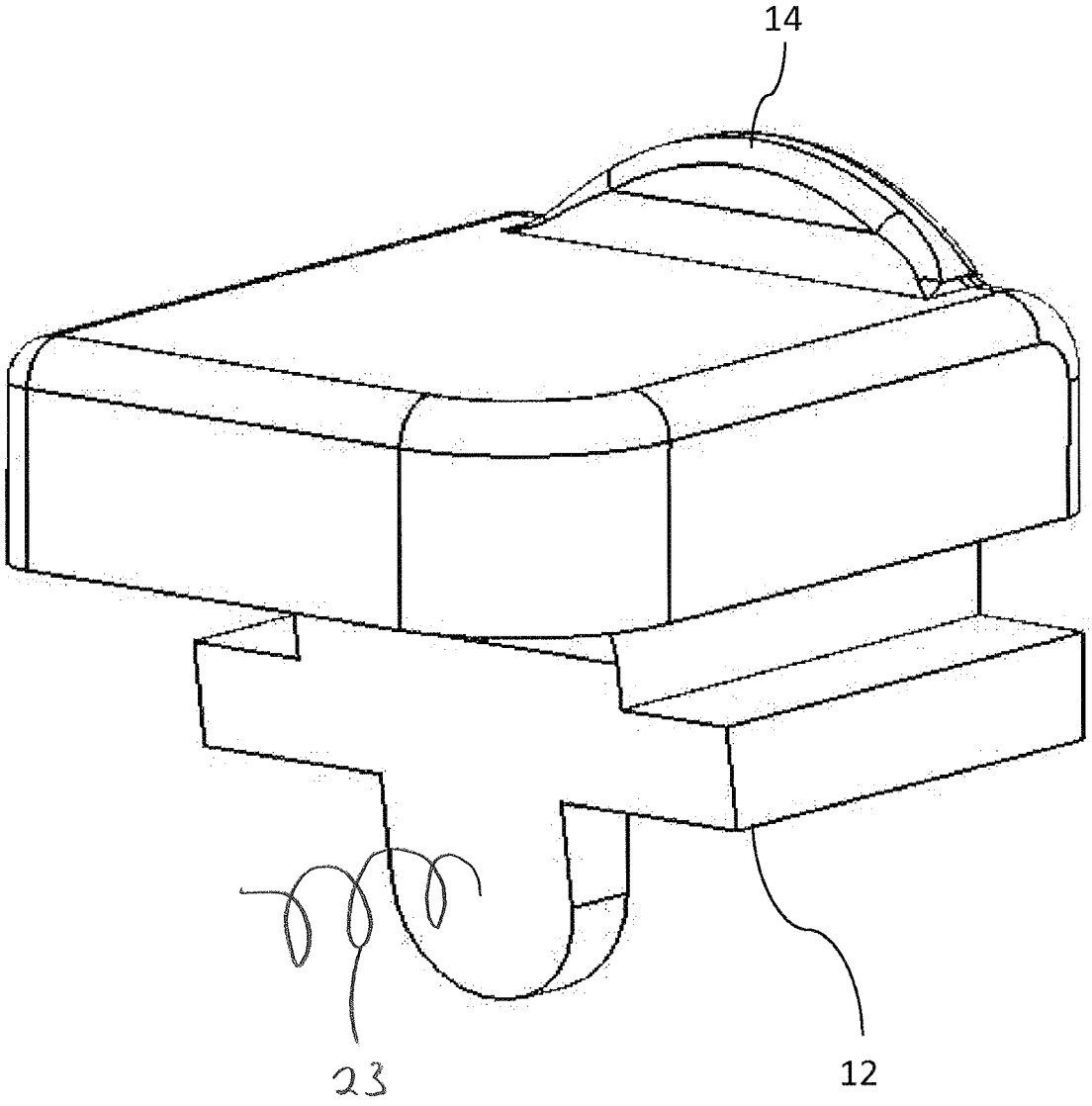
FIG. 12 illustrates an isometric view of the slider.
Figure 13:
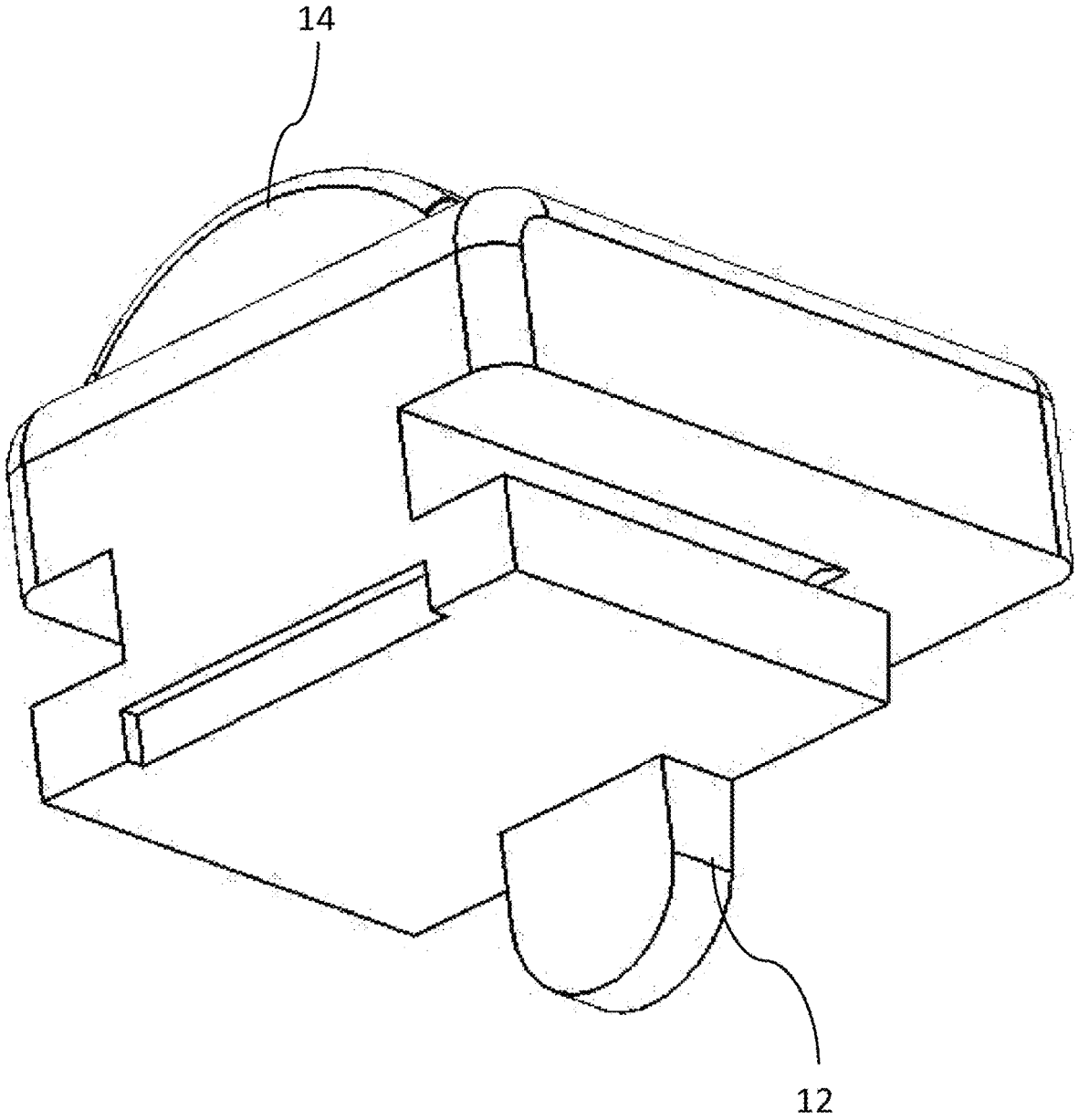
FIG. 13 is another isometric view of the slider.
Figure 14:
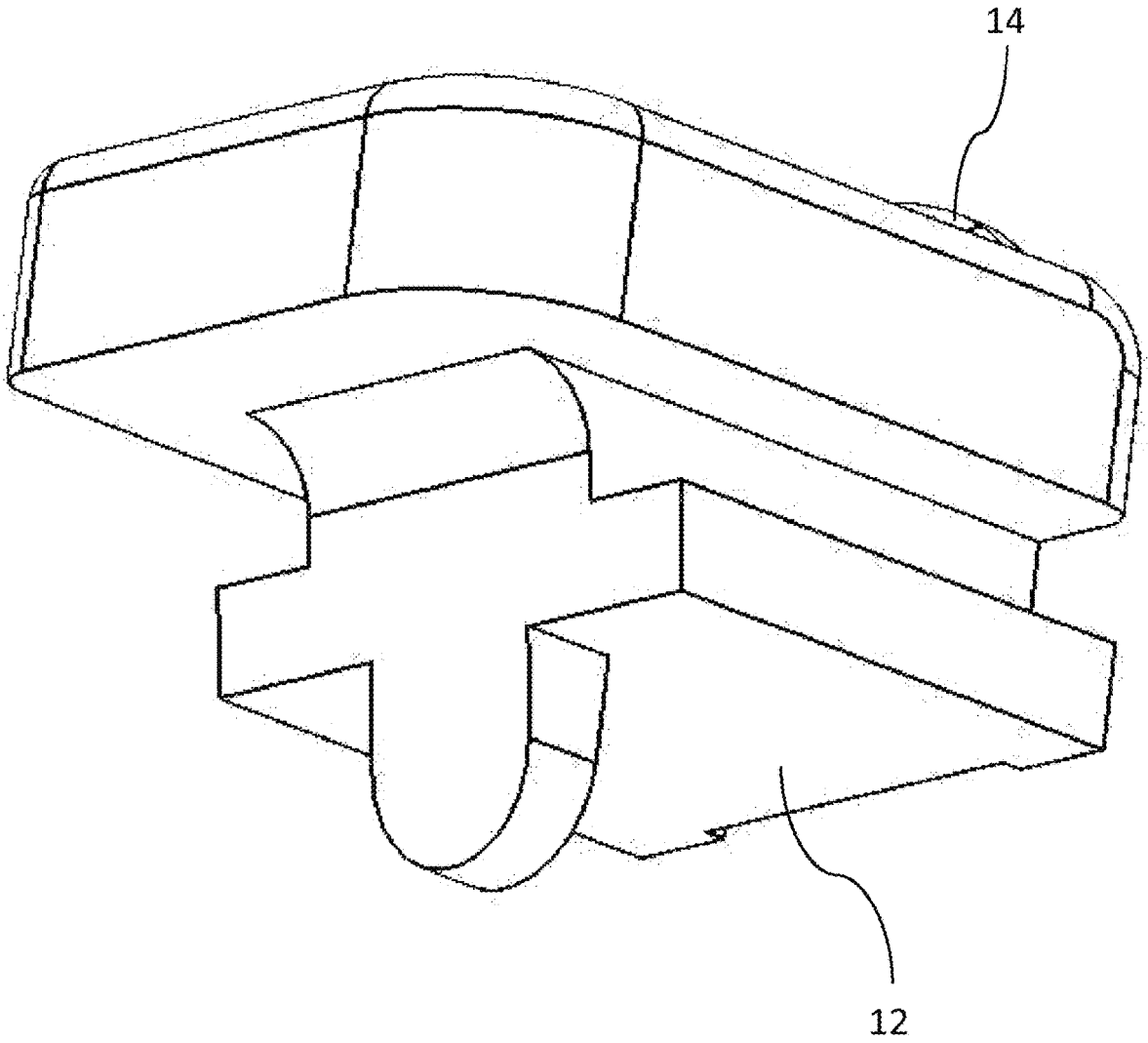
FIG. 14 is another isometric view of the slider.
Figure 15:
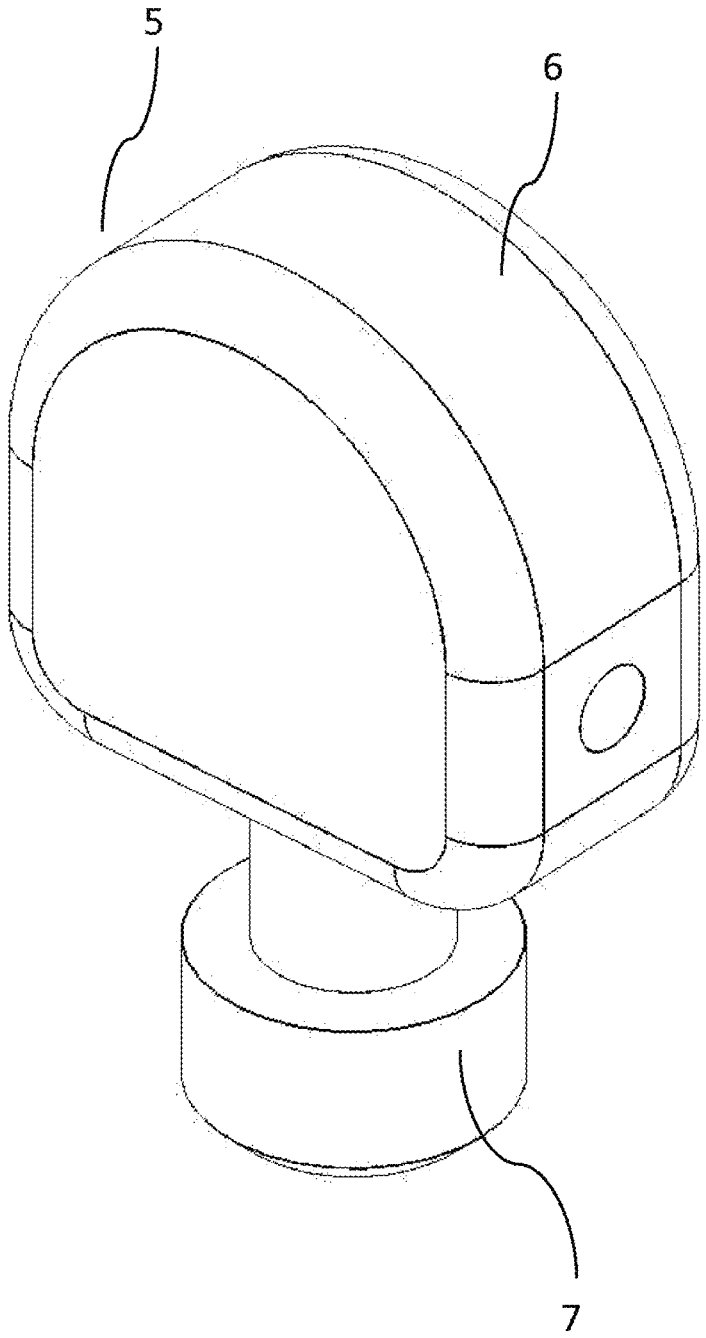
FIG. 15 is an isometric view of the latch.
Figure 16:
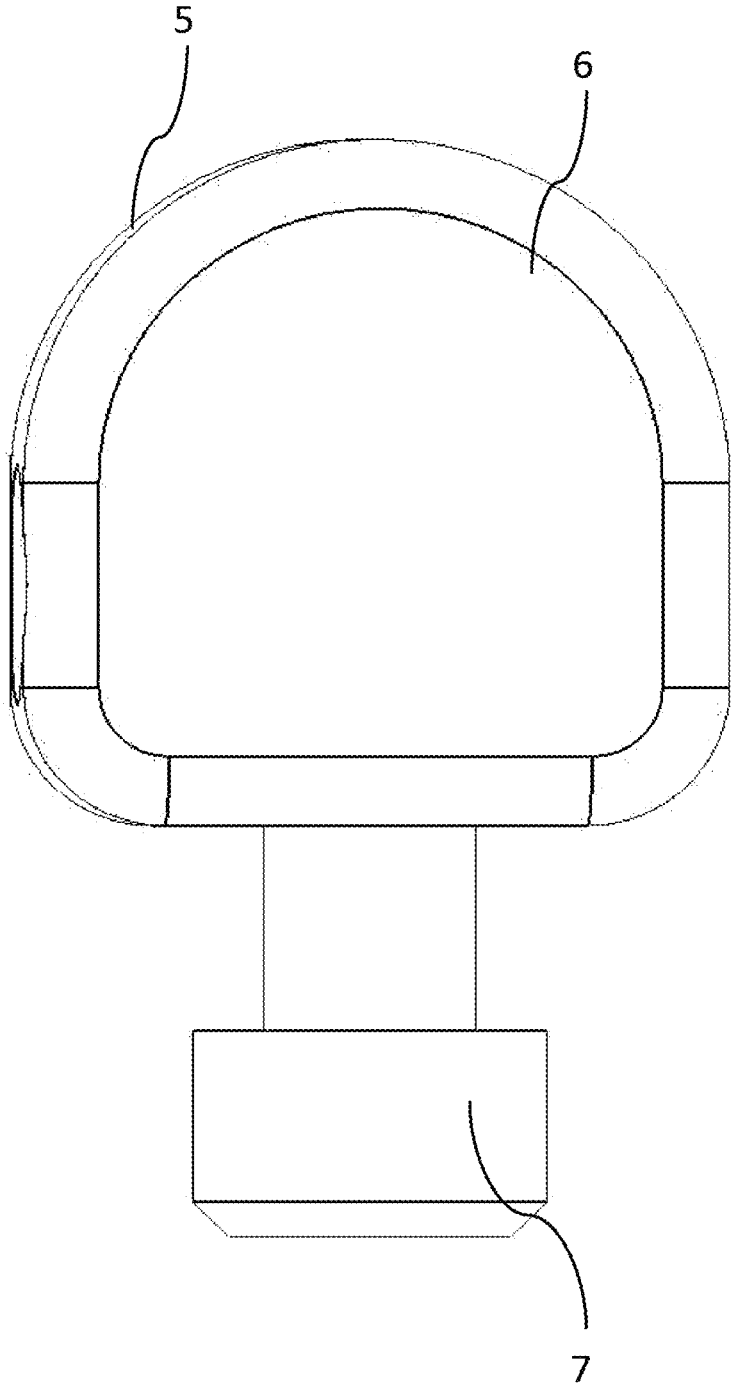
FIG. 16 is a side view of the slider.
Figure 17:
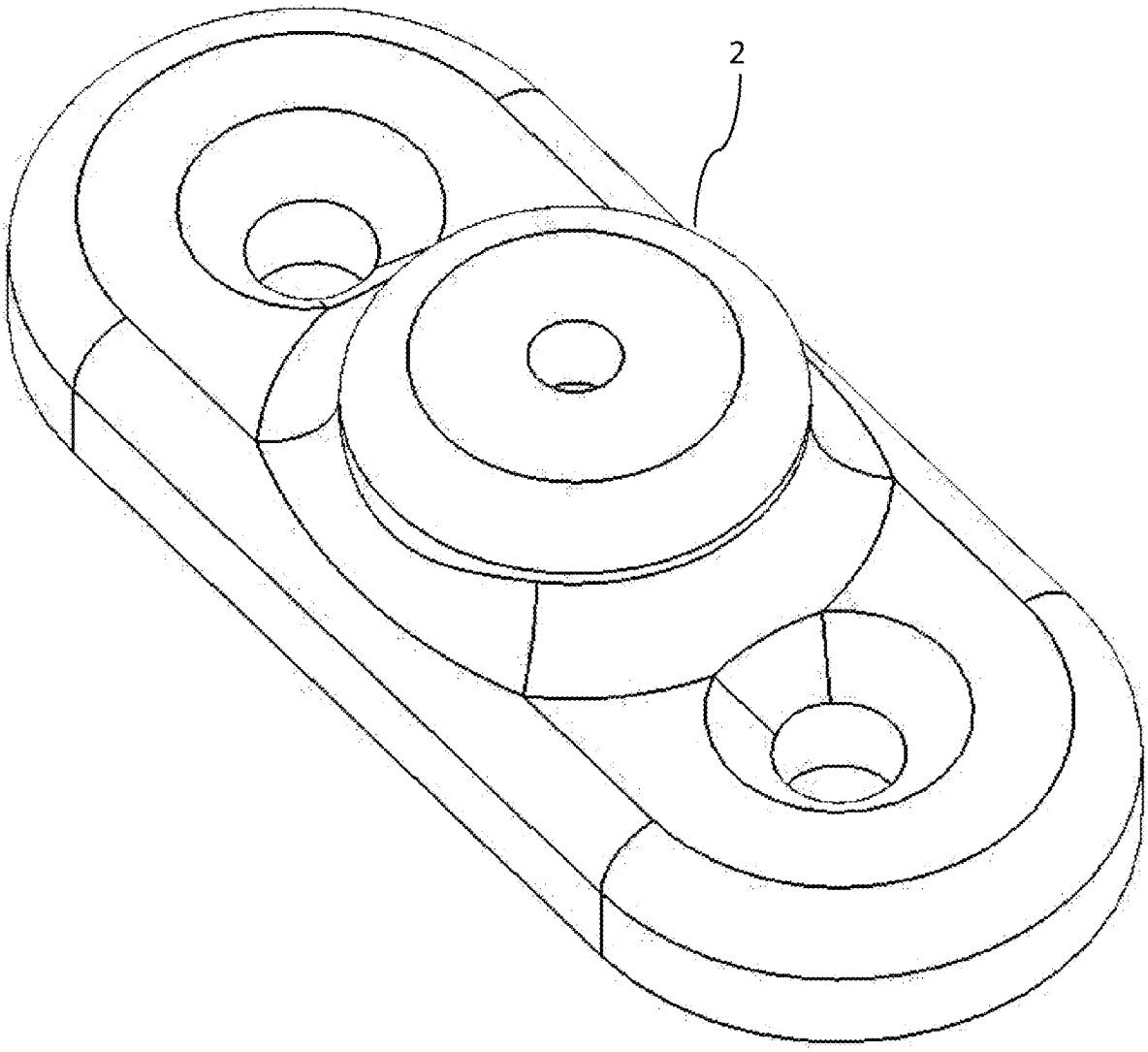
FIG. 17 is an isometric view of the latch mounting base.

A cord lock blocker may be arranged to selectively hold the lock in the lock receptor. FIGS. 1 and 2 show a cord lock blocker in the form of a slider 12. The slider 12 moves along a channel 13 which is perpendicular to the channel 10. The slider 12 is biased to move into channel 10 to block the cord lock (e.g., latch engagement member 7). As may be seen in FIGS. 4-6, and particularly in FIG. 6, the slider 12 may be positioned over an upper surface 24 of the insertion member (e.g., latch engagement member 7). With the slider in this position, the cord lock cannot be moved away from the lock receptor in the direction of the opening 11.

The slider 12 may have a top protrusion 14 to allow a user to grasp and slide the slider 12 within the channel 13. By pulling or pushing against the bias of a spring 23 or other biasing member, the slider can be moved so that the slider no longer prevents the insertion member from being removed.

Any suitable type of biasing member may be used to bias the slider 12 toward the locking position. For example, a coil spring, a leaf spring, a resilient material, or any other suitable arrangement may be used.

The latch reception base 8 may also include a holding tab 15 that holds the slider 12 within channel 13, such that holding tab 15 has to be moved prior to sliding the slider 12 out of the channel 10. The holding tab 15 may be pivotably mounted to the latch reception base 8, and/or may form an interference fit when pushed into the holding position.

In alternative embodiments, the latch engagement member 7, or other cord lock, is movable along the channel 10 to an end of the channel that is opposite to the opening 11. In these embodiments, the slider 12 is moved out of the channel 10, the latch engagement member 7 is slid along the channel, and then slider is released, such that the slider returns into the channel 10. In this position, the latch engagement member 7 is prevented from traveling along the channel 10 toward the opening 11 by a surface 25, and therefore is held within the lock receptor. In such embodiments, the spring or other biasing element may be positioned sufficiently low on the slider so that the spring does not interfere with the lower portion of the cord lock during sliding.

For purposes herein, the term "flexible cord" is meant to include any suitable type of cord, cable, rope, chain, wire, or other component that is formed with an elongated, flexible material. Also for purposes herein, "finger-graspable" is intended to include any suitable arrangement for pushing, pulling, or otherwise applying a force on a component with one's finger(s) or thumb. The use of an additional finger to brace against another component does not change a finger-graspable portion to being not finger-graspable.

In use, embodiments of the window lock assembly may be easily installed. In some embodiments, locking and releasing may be achieved with single handed operation, while in other embodiments, two handed operation is used.

The corners and top extending surfaces of the window lock assembly components may have rounded edges to limit sharp edges and corners.

For purposes herein, the term "substantially" is defined as at least close to (and can include) a given value or state, as understood by a person of ordinary skill in the art.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A window lock comprising:

a first mount configured to be attached to a first window component;

a flexible cord attached to the first mount at a first location of the cord;

a cord lock attached to the flexible cord at a second location of the cord at a distance from the first mount;

a second mount including a lock receptor configured to removably receive the cord lock, the second mount being configured to be attached to a second window component;

the second mount including a cord lock blocker which is slideably movable between a first position and a second position, wherein in the first position, the cord lock blocker blocks removal of the cord lock from the lock receptor, and in the second position, the cord lock blocker does not block removal of the cord lock;

and wherein the cord lock blocker is biased toward the first position and is movable to the second position by applying a force to a finger-graspable portion of the cord lock blocker;

wherein the cord lock includes an insertion member, and the lock receptor includes an opening configured to receive the insertion member as the insertion member travels in a first lock insertion direction into the opening, the opening extending into a channel within the lock receptor, and the channel is configured to permit the insertion member to slide within the channel in a second direction which is different from the first lock insertion direction after receiving the insertion member into the opening;

wherein to remove the cord lock from the lock receptor, the insertion member has to be removed through the opening; and wherein the cord lock blocker is movable in a blocking direction and an opposing unblocking direction which are transverse to the second direction, such that the cord lock blocker blocks or unblocks the insertion member within the channel.

2. A window lock as in claim 1, further comprising a holding tab which is configured to selectively hold the cord lock blocker in the first position.

3. A window lock as in claim 1, wherein the first mount includes at least one hole configured to receive a screw to attach the first mount to the first window component, and the second mount includes at least one hole configured to receive a screw to attach the second mount to the second window component.

4. A window lock as in claim 1, wherein the first mount is attached to the first window component, and the second mount is attached to the second window component.

5. A window lock as in claim 1, wherein the cord lock blocker moves in a blocking direction that is perpendicular to the second direction.

6. A window lock as in claim 1, wherein the finger-graspable portion comprises a protrusion extending outwardly from the blocker.

7. A window lock as in claim 1, wherein the blocker is spring-biased toward the first position.

8. A window lock as in claim 1, wherein the cord lock blocker prevents movement of the cord lock along a length of the lock receptor.

9. A method of locking and unlocking a window, comprising:

(a) attaching a first mount to a first window component, the first mount including a flexible cord attached to the first mount at a first location of the cord, and a cord lock attached to the flexible cord at a second location of the cord at a distance from the first mount;

(b) attaching a second mount to a second window component, the second mount including a lock receptor configured to removably receive the cord lock;

(c) in the lock receptor, slideably moving a cord lock blocker away from a first position;

(d) inserting the cord lock in the lock receptor by moving the cord lock in a first lock insertion direction into an opening of the lock receptor;

(e) sliding the cord lock within a channel in a second direction which is different from the first lock insertion direction, where the channel extends from the opening;

wherein to remove the cord lock from the lock receptor, the insertion member has to be removed through the opening;

(f) releasing the cord lock blocker such that a biasing element moves the cord lock blocker into the first position which prevents removal of the cord lock from the lock receptor by blocking the cord lock within the channel;

(g) slideably moving the cord lock blocker from the first position to a second, unblocking position by applying a force to a finger-graspable portion of the cord lock blocker;

(h) sliding the cord lock within the channel to the opening; and (i) removing the cord lock from the lock receptor through the opening.

10. A method as in claim 9, wherein the cord lock blocker moves in a blocking direction that is perpendicular to the second direction.

11. A window lock as in claim 1, wherein the flexible cord is attached to the first mount at an attachment location which is not movable relative to the first mount.

12. A method as in claim 9, wherein the biasing element comprises a spring.

13. A method as in claim 9, wherein in act (c), slideably moving the cord lock blocker comprises applying a force to a finger-graspable portion of the cord lock blocker, and in act (f), releasing the cord lock blocker comprises letting go of the finger-graspable portion of the cord lock blocker.

14. A method as in claim 9, wherein act (c) comprises moving the cord lock blocker out of the channel.

15. A method as in claim 9, wherein the cord lock blocker comprises a slider.

16. A window lock as in claim 1, wherein the cord lock blocker comprises a slider.

* * * * *